US010119558B2

(12) United States Patent
Biwersi et al.

(10) Patent No.: US 10,119,558 B2
(45) Date of Patent: Nov. 6, 2018

(54) CONTROL APPARATUS

(71) Applicant: HYDAC FILTERTECHNIK GMBH, Sulzbach/Saar (DE)

(72) Inventors: Sascha Alexander Biwersi, Mettlach (DE); Marcus Hettiger, Saarlouis (DE); Marcus Simon Specks, St. Ingbert (DE); Christoph Stoenner, St. Ingbert (DE); Marcus Karl Pfeiffer, Voelklingen (DE); Erik Lautner, Berlin (DE)

(73) Assignee: HYDAC FILTERTECHNIK GMBH, Sulzbach/Saar (DE)

( * ) Notice: Subject to any disclaimer, the term of this patent is extended or adjusted under 35 U.S.C. 154(b) by 0 days.

(21) Appl. No.: 15/026,263

(22) PCT Filed: Sep. 24, 2014

(86) PCT No.: PCT/EP2014/002583

§ 371 (c)(1),
(2) Date: Mar. 31, 2016

(87) PCT Pub. No.: WO2015/055276

PCT Pub. Date: Apr. 23, 2015

(65) Prior Publication Data

US 2016/0258450 A1 Sep. 8, 2016

(30) Foreign Application Priority Data

Oct. 15, 2013 (DE) ..... 10 2013 017 093

(51) Int. Cl.
*F15B 13/042* (2006.01)
*F15B 13/02* (2006.01)
(Continued)

(52) U.S. Cl.
CPC ..... *F15B 13/042* (2013.01); *F15B 13/026* (2013.01); *F15B 13/0402* (2013.01);
(Continued)

(58) Field of Classification Search
CPC ..... F15B 13/042; F15B 13/0402; F15B 13/0417; F15B 13/0803; F15B 20/08; F15B 21/003; F15B 21/042; Y10T 137/86574
See application file for complete search history.

(56) References Cited

U.S. PATENT DOCUMENTS

| | | | | |
|---|---|---|---|---|
| 7,487,707 | B2 * | 2/2009 | Pfaff | F15B 11/003 91/437 |
| 8,210,206 | B2 * | 7/2012 | Coakley | F15B 13/0402 137/554 |
| 2005/0139274 | A1 | 6/2005 | Patel | |

FOREIGN PATENT DOCUMENTS

| | | |
|---|---|---|
| DE | 196 47 994 | 5/1998 |
| DE | 199 48 232 | 1/2001 |

(Continued)

OTHER PUBLICATIONS

WO0209077A2translation.*
International Search Report (ISA) dated Jan. 19, 2015 in International (PCT) Application No. PCT/EP2014/002583.

*Primary Examiner* — Craig Schneider
*Assistant Examiner* — Kevin Barss
(74) *Attorney, Agent, or Firm* — Wenderoth, Lind & Ponack, L.L.P.

(57) ABSTRACT

A control device, in particular for hydraulically controlling components of mobile working machines, has a pressure supply connection (P) and a tank or return connection (T) in addition to two user connections (A, B). Control and/or regulating valves (10, 14, 16, 18) are connected between the individual connections (P, T, A, B). Two control lines (C, Z) can control at least one of the control and/or regulating valves. A modular-type functional block (24, 26) is connected to at least one of the control lines (C, Z).

11 Claims, 9 Drawing Sheets

(51) Int. Cl.

| | |
|---|---|
| ***F15B 13/04*** | (2006.01) |
| ***F15B 13/08*** | (2006.01) |
| ***F15B 20/00*** | (2006.01) |
| ***F15B 21/04*** | (2006.01) |
| ***F15B 21/00*** | (2006.01) |
| *F15B 13/00* | (2006.01) |

(52) U.S. Cl.

CPC ..... *F15B 13/0417* (2013.01); *F15B 13/0803* (2013.01); *F15B 20/008* (2013.01); *F15B 21/003* (2013.01); *F15B 21/042* (2013.01); *F15B 2013/006* (2013.01); *F15B 2211/30535* (2013.01); *F15B 2211/6355* (2013.01); *F15B 2211/65* (2013.01); *F15B 2211/67* (2013.01); *F15B 2211/8636* (2013.01); *F15B 2211/8752* (2013.01); *Y10T 137/86574* (2015.04)

(56) References Cited

FOREIGN PATENT DOCUMENTS

| | | |
|---|---|---|
| DE | 100 58 032 | 5/2002 |
| EP | 1 243 799 | 9/2002 |
| WO | 02/090778 | 11/2002 |
| WO | 2004/099657 | 11/2004 |

* cited by examiner

CONTROL APPARATUS

FIELD OF THE INVENTION

The invention concerns a control device, in particular for the hydraulic control of components of mobile machines, comprising at least one pressure supply connection and one tank or return connection as well as two load connections. Control and/or regulating valves are connected between the individual connections. Two control lines are able to control at least one of the control and/or regulating valves.

BACKGROUND OF THE INVENTION

DE 42 30 183 C2 discloses a control device for hydraulic motors comprising at least one directional control valve, which may be connected via a supply line to a pump acting as pressure supply device, via a discharge line to a tank or return connection and via at least one output line to a hydraulic motor. A supply line regulator is disposed in the supply line. A control line is applied with a load-dependent control pressure that may be connected to the output line via a load sensor disposed in the directional control valve. The load sensor may be activated directionally-dependent, and with at least one relief line that leads from the control line via the directional control valve to the discharge line. At least one safety valve is disposed in the relief line. The safety valve may be activated into an open position when a predetermined load limit or movement limit is reached. The relief line in the directional control valve may be switched into the open position depending on direction and synchronously with the respective activated load sensor.

Because the safety valve in the known solution is disposed in a section of the relief line that is located between the port of the directional control valve and the discharge line, the section of the relief line that contains the safety valve remains depressurised until the safety valve is used for the monitoring of the movement direction of the hydraulic motor that is assigned to it. Thus, the known solution ensures that different safety valves may be defined for each movement direction independently.

SUMMARY OF THE INVENTION

An object of the invention is to provide an improved control device in such a way that its functional range is increased, and thus, an increased functional reliability is also achieved.

This object is basically met by a control device with a modular-type function block connected to at least one of its control lines. Further control and regulating tasks may be solved, and an increase in functional reliability of the overall control device may be achieved depending on the design of the function block. For the average person skilled in the art of such hydraulic control devices and given a suitable design of the modular function block, surprisingly the design may be reengineered through multiple further arrangements, and thus, also increase the functional reliability of existing control devices.

In a preferred embodiment of the control device according to the invention, the function block is connected to a specific load-sensing line at its inlet port. The known pressure-limiting and shutdown functions for the load-sensing signal usually consider only the sectionally relevant load-sensing pressures A and B of the output or load connections present in this section. With the function block solution according to the invention it is possible to lead out the signal sent from the previous sections to this section, and the signal sent to the next section (before and after a sectional two-way valve), and to manipulate it with the function block accordingly. Considering the ever increasing safety requirements that are demanded, a person skilled in the art is now provided with additional design options for control devices of this kind.

Particular advantageously the function block can be configured to be employed as a pressure limiting valve, for example, and to control a load-sensing line LP with the control pressure. In another also preferred embodiment, the function block is provided with an electromagnetically operable directional control valve, which receives on its input port the pressure from another load-sensing line LS.

In a further preferred embodiment of the control device according to the invention, the function block employed is connected to one of the control lines of the control device. This way compensation for a possible failure of a pressure reducing valve or a possible failure of an electro-proportional pressure control valve is possible. Those valves are commonly used as control and/or regulating valves in such control devices and clearly increase the functional reliability of control devices of this kind. Thus, a modular system with regard to the functional reliability of the hydraulic pilot control according to DIN EN ISO 13849 in hydraulically operating machines is created. Further functional blocks that may be employed advantageously are depicted in FIG. 1*a*.

Particularly surprising to the average person skilled in the art when designing such control devices is that the respective function block can be utilised, when appropriately designed, to temper the fluid volume flow of an entire hydraulic circuit. Particularly in winter, or when the hydraulic control device is used in very cold regions, the tempering of the oil volume flow makes sense to prevent malfunctions.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure and that are schematic and are not to scale.

DETAILED DESCRIPTION OF THE INVENTION

Where connection points, lines or valves are indicated in the hydraulic control circuits, they will not be explained in detail since they are part of the common nomenclature of this field.

Figure 1:
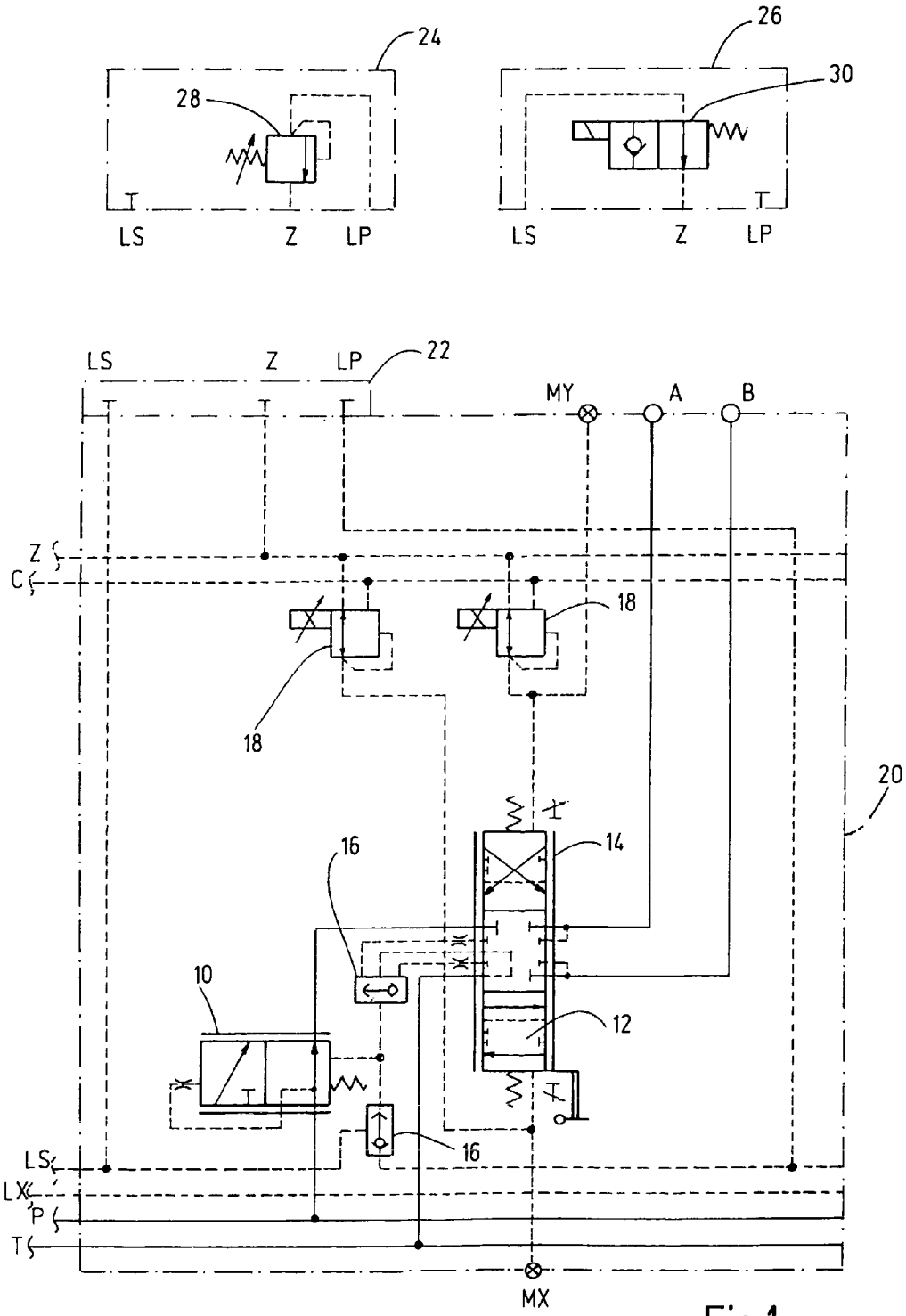
FIGS. 1, 1*a*, 1*b*, 2, 3*a*, 3*b*, 4*a*, 4*b* and 5 are hydraulic control circuit diagrams of control devices according to exemplary embodiments of the invention.

The representation according to FIG. 1 concerns a control device, in particular for the electro-hydraulic control of components in mobile machines, which are not shown here in detail. The control device shown comprises a pressure supply connection P as well as a tank or return connection T and, moreover, two load connections A, B to which a hydraulic load, for example in form of a power cylinder or in form of a hydraulic motor may be connected. Shown, moreover, are two control lines C and Z as well as load-sensing lines LS, LX and LP besides the associated load-sensing connections. Amongst other items, an individual pressure compensator 10 is used as a control and regulating valve of the control device, which is disposed upstream of the control spool 12 of a directional control valve 14, which may be designed as a proportional pressure control valve, for example. Moreover, two two-way valves 16 are employed as well as two electro-proportional pressure control valves 18, which control the control spool 12 of the directional control valve 14 in its shifted position at the outlet side on opposing ends. The control device is designed in form of a valve block 20 and is provided on at least one of its sides with a flange 22 for the purpose of connecting different modular function blocks 24, 26.

The load-sensing signal in conjunction with the individual pressure compensator 10, which is disposed upstream of control spool 12 has, in the instance of volume-controlled mobile valves, a significant influence on their functional characteristics. If, for example, the load-sensing signal is limited to a certain set value through a pressure relief valve.

The individual pressure compensator 10, through its closing action, ensures that the load volume decreases continually when this value is reached. If the load-sensing signal is not limited to a set pressure, but is fully balanced towards the tank connection T, the individual pressure compensator 10 remains in its closed position. When the control spool 12 moves, none of the fluid is able to flow via the individual pressure compensator 10, and thus, via the control spool 12 towards the loads that are each connected to the load connections A, B. Thus, the operation is disabled by the pressure supply device P, for example a hydraulic pump, in the direction of the loads that are connected to the load connections A, B. Readily conceivably, the manipulation of the load-sensing signal is of great significance with respect to the safety concerns in machine design. Integrated into the individual spool sections, the individual overpressure limitation of the load-sensing signal for the load connections A and B is standard from today's perspective. Besides other possible pressure limiting functions, electrically operated shutoff valves are also prior art and are described, for example, in DE 42 30 183 C2.

The known pressure-limiting and shutoff functions for the load-sensing signal only consider the load pressures A and B of the output or load connections of this section. The signal that is present at this section from the previous section, and the signal transmitted to the next section (upstream and downstream of the sectional two-way valve) is made available externally, according to the invention, and may be manipulated there as required.

As shown in FIG. 1, using the LP load-sensing connection with its associated line, all previous sections can be limited with only a single pressure limiting valve 28 (mechanically, electrically activated or electro-proportional), instead of up to two per section. The prerequisite is that all load connections of the previous sections are limited to the same low system pressure. Furthermore, all previous sections can be shut off with only a single 2/2-way valve 30. Via the load-sensing line LS and the associated LS connection, the same manipulative range of functions can be achieved as with the load-sensing line LP. The only exception is that the load-sensing signal of the section associated with this connection is also taken into consideration.

As depicted in FIG. 1, the load-sensing lines LP and/or LS with their respective connections may either be part of a flange 22 of the valve block 20 for the control device, or they may be implemented as part of the usual threaded connections. According to the diagram in FIG. 1, the function block 24 contains the pressure limiting valve 28 to be connected. The other function block 26 contains the directional control valve 30. The lines LS, Z and LP shown connected to the function blocks 24, 26 must be connected in a fluid-conducting manner with the corresponding connections LS, Z and LP in flange 22 to ensure functional reliability when in use. When using this design, the control line Z is optional and may, as depicted in FIG. 1, be used as internal oil overflow line Z, or it may lead into the tank line T. In addition to the connections LP and/or LS, the connections LA, LB and LR (FIG. 1*b*) may also be made externally available, depending on the machine design. FIG. 1*b* depicts a correspondingly changed drawing, which is otherwise the same design as that of FIG. 1 but omits the function blocks 24, 26 to simplify the drawing.

Figure 1A:
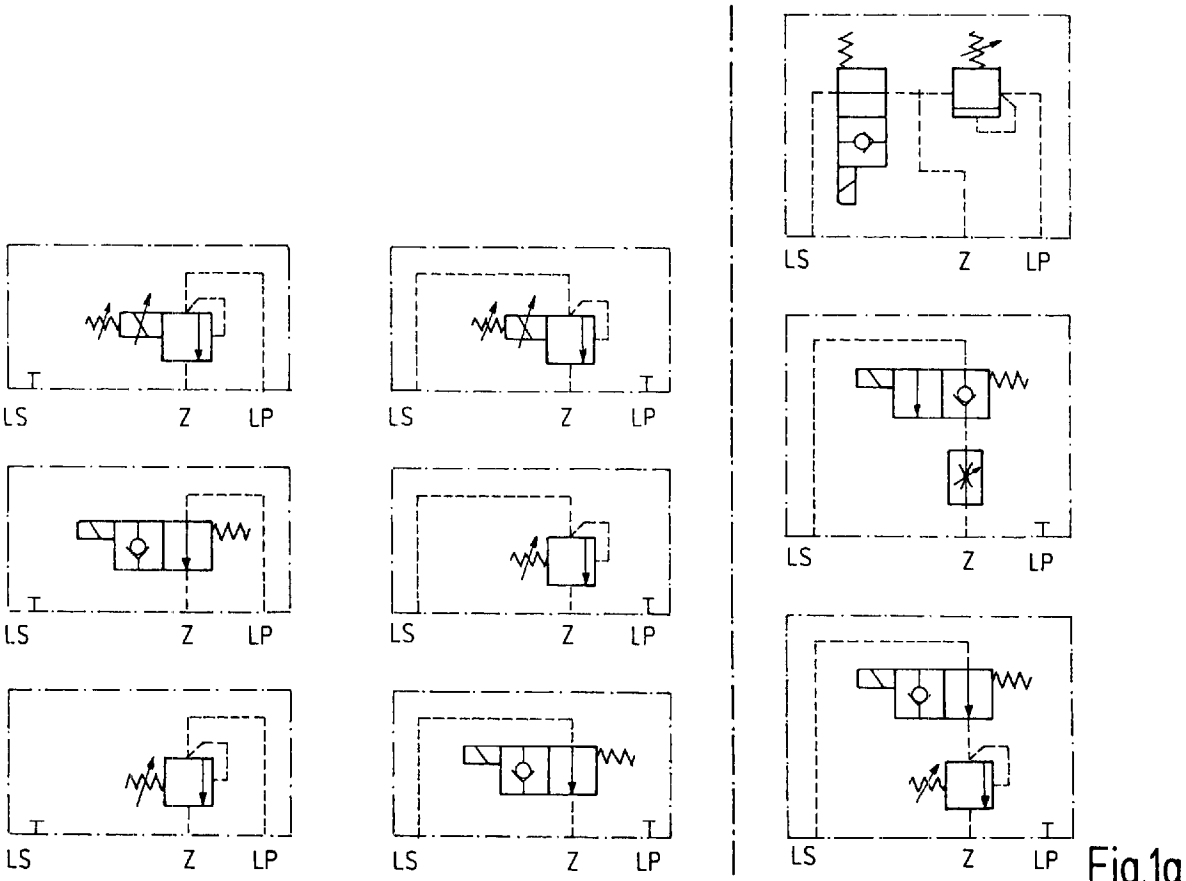
Figure 1B:
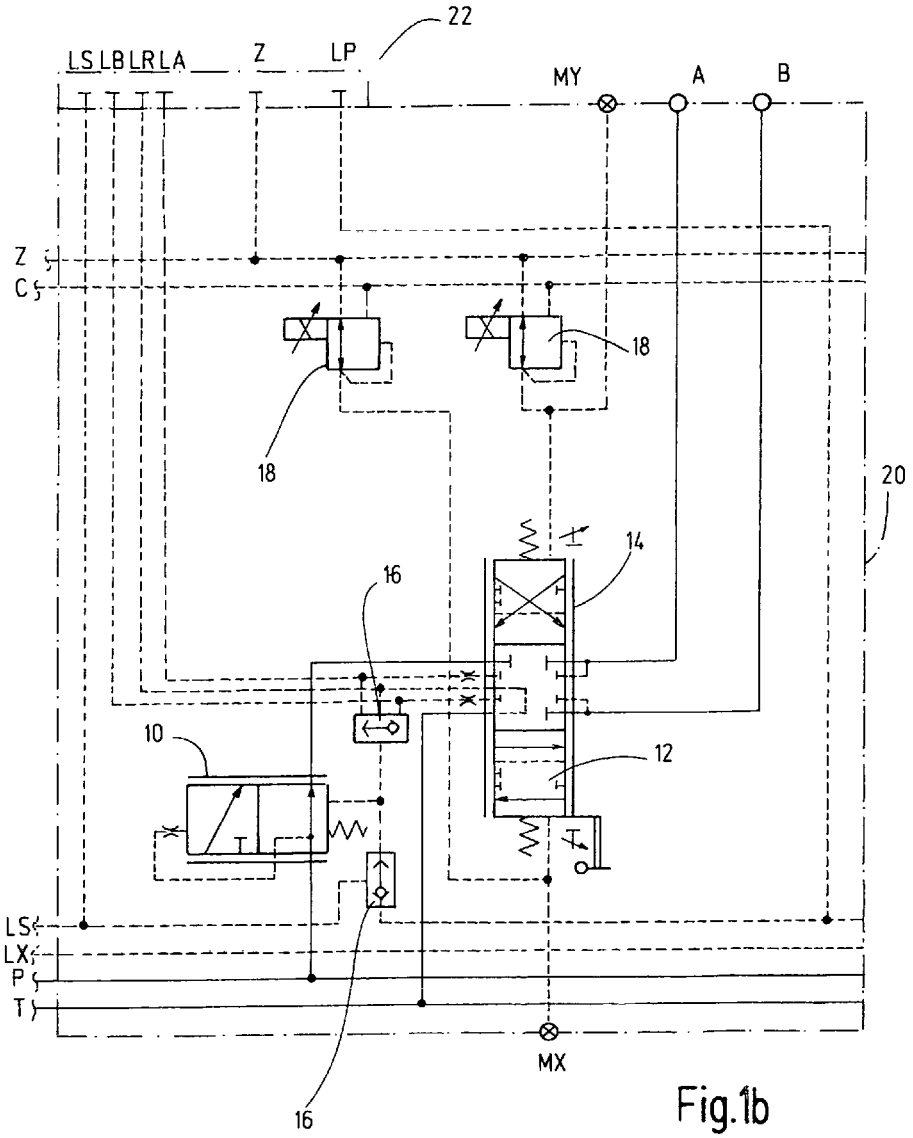

As is also shown in FIG. 1*a*, further function blocks (framed in dashed lines) with their valve assembly components that correspond to common hydraulic circuit diagrams, may be connected via the connections LS, LP and Z to global control devices as shown, for example, in FIGS. 1 and 1*b* as described previously, in order to achieve, in this manner, changed functions for the control device and to increase the modularity of the overall concept. The left-hand side of FIG. 1*a* depicts individual modules as function components. The opposite right-hand side shows combinations of modules of multiple valve function elements in a function block to be connected. Further logic circuits with or without other modules can also be achieved for the load-sensing lines LA, LB and LR (cf. FIG. 2).

Moreover, with the described function blocks according to the invention, a design addressing the functional reliability of the pilot pressure of the hydraulic pilot-controlled main spool 12 of the directional control valves 14 described so far can also be achieved.

The prior art teaches using a hydraulic auxiliary force in hydraulic pilot-controlled directional control valves 14 so that the control element, regularly in form of the control spool 12, is moved into a desired position. The auxiliary force or pilot pressure may be applied independently from outside, or via an internal control/regulating circuit, to the opposing ends of the control spool 12. The commonly used maximum pressures are between 15 and 25 bar. To ensure a constant control or regulating accuracy respectively, care must be taken in hydraulic circuits for mobile equipment that, due to the dynamic pressure patterns, the electro-proportional control valves receive a defined and constant supply pressure. This is why the pump pressure is reduced from the current working pressure to a defined value using an internal pressure reducing valve 32, or an external supply pump (not shown) is used. In most cases the pilot control circuits are, in terms of stress resistance, designed for this low pressure level.

Considering the possibilities of failure in this pilot control circuit, not only the pressure reducing valve 32 can fail, but also the individual electro-proportional control valves 18 for the respective control spool sides. If, for example, the pressure reducing valve 32 seizes, the high-pressure side will be connected to the low-pressure side. The potential for a dangerous situation is very high. If, on the other hand, a control valve 18 seizes in its control position, one control spool side would be permanently exposed to a pilot control pressure. An uncontrollable machine operation would be the consequence. If in this instance the low-pressure supply cannot be shut off, the emergency operation by hand lever is also no longer certain. Today's state of the art primary measures include, amongst others, certain design principles for the individual components. Since contamination is still today the most common reason for malfunctions, protective strainers or filter devices 34, as depicted in an exemplary manner in FIG. 2, disposed in fluid flow direction upstream of the pressure reducing valve 32 as well as, if necessary, upstream of the control valves 18, are also part of the other primary protective mechanisms. Secondary measures that may be used can be additional pressure limiting valves (not shown).

To create a cost-effective alternative to the respective secondary-measure pressure limiting valve, a further function block 36 was created for the design of the control device, which is depicted as a valve block 20. One fundamental disadvantage of pressure limiting valves is that the activation of the valve is not necessarily recognisable by the machine operator. To be able to detect the activation of the pressure limiting valve, and thus, the malfunction of the pressure reducing valve, a pressure switch or pressure sensor would be required in addition to a pressure limiting valve. This addition creates significant additional costs.

Figure 2:
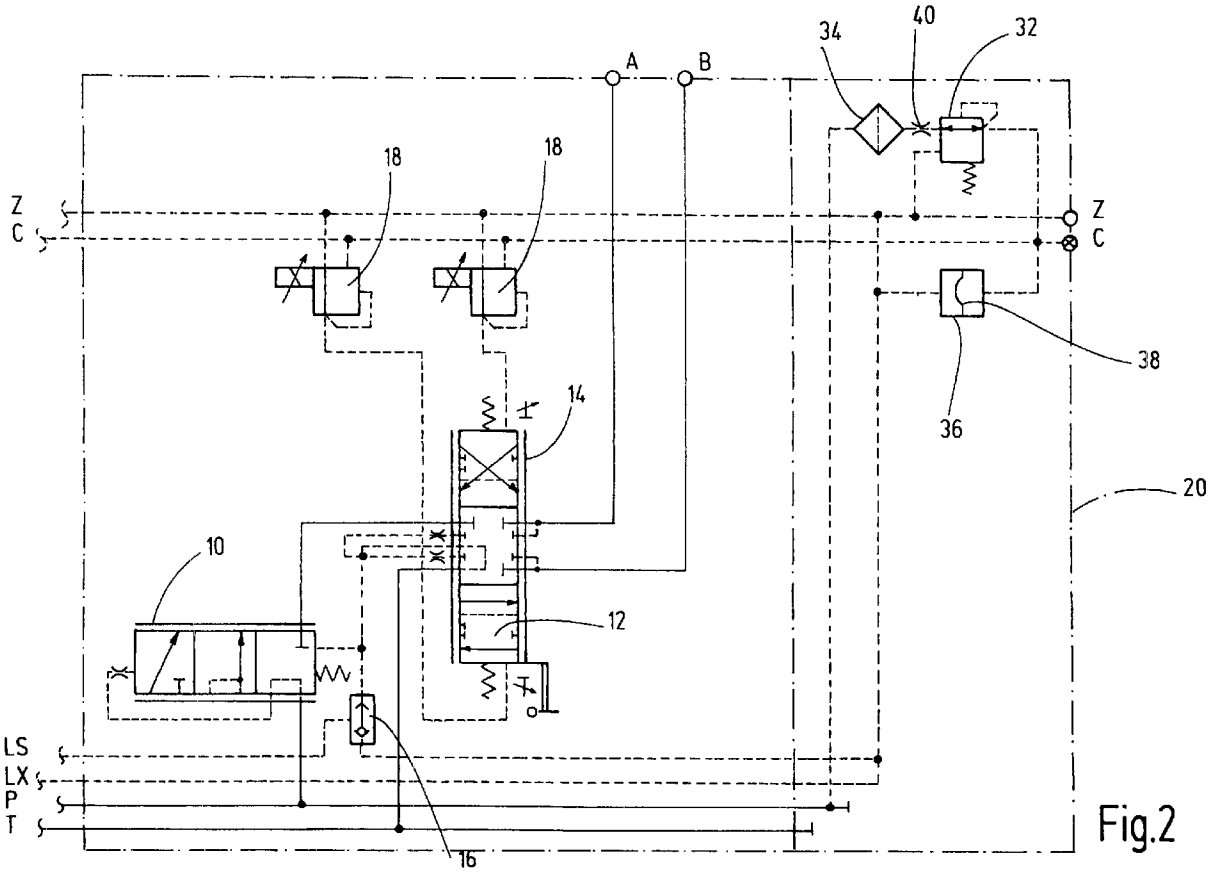

To avoid those additional costs, a safety device against overpressure is employed inside the function block 36 in the control device according to FIG. 2, instead of the known pressure limiting valve. In the exemplary embodiment according to FIG. 2, the safety device against overpressure takes the form of a rupture disc 38 of the commonly used type. If the admissible pressure upstream of the control valves 18 is exceeded, the rupture disc 38 is destroyed and, with the aid of an inlet nozzle 40 that is disposed upstream of the pressure reducing valve 32, the pressure is fully relieved upstream of the control valves 18, in particular via the control line C. Controlling the valve spool 12 of the directional control valve 14, and thus controlling the operation of the loads via the control valves 18, is no longer possible. Via a commonly used manual lever action (not shown), the machine connected to the control device can still be operated and moved out of a dangerous situation if necessary.

Figure 3A:
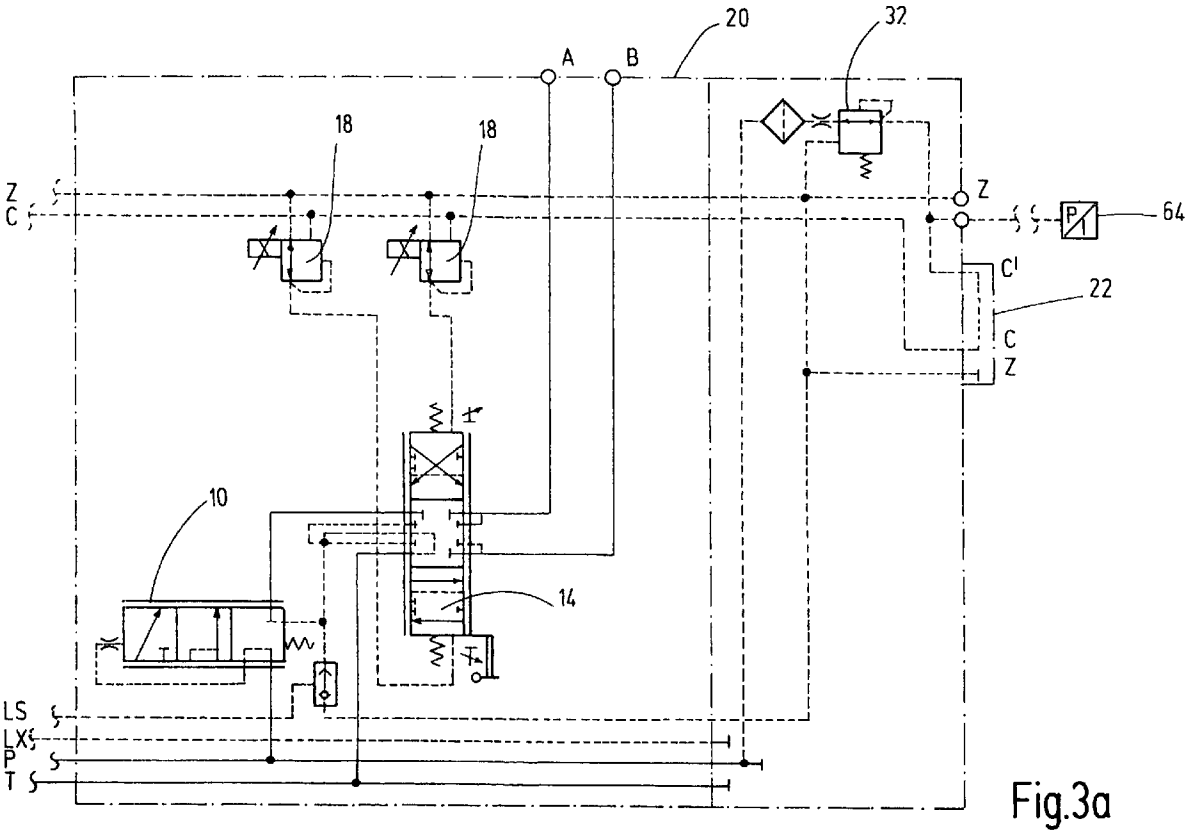
Figure 3B:
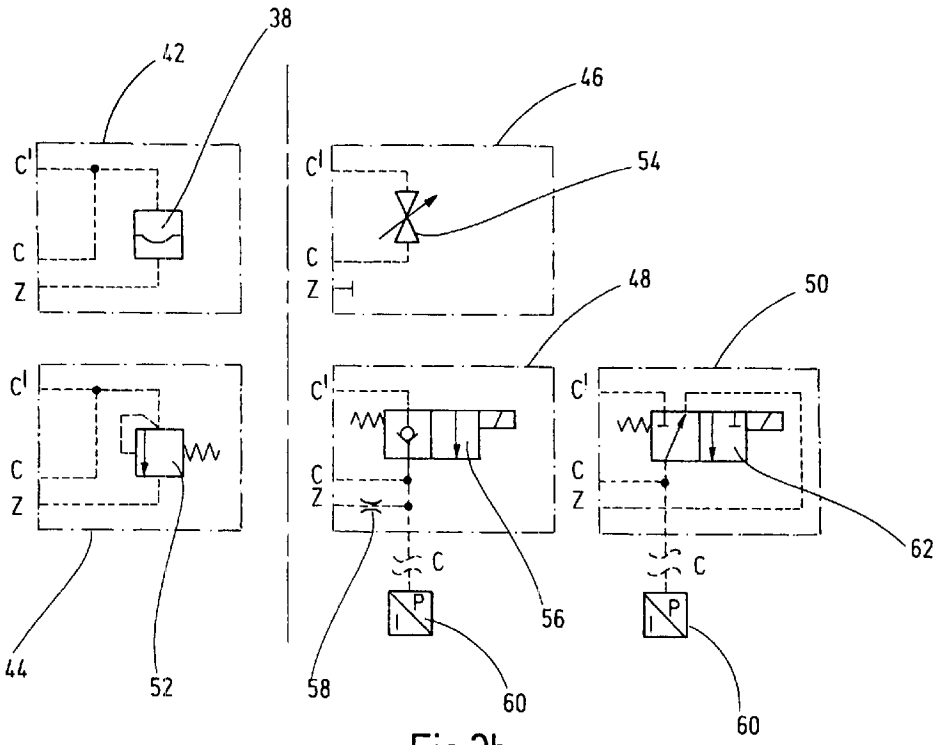

With the device according to the invention, the malfunction can then be immediately recognized without the aid of electronic devices. By using the manual lever actuation, the machine can still be brought into a "safe state". As part of the function block 36, the rupture disc 38 may be integrated either into the flange plate or connection plate 22 or directly into an end plate of the valve block 20 of the control device. In developing this thought further and to achieve an overall modular system with regard to the functional reliability of a hydraulic pilot control system according to DIN EN ISO 13849 for machines, a predefinable flange design C', C and Z is specified according to the solution depicted in FIGS. 3*a*, 3*b* on the connection or flange plate 22 of valve block 20. From the flange design C', C and Z the pressure between the pressure reducing valve 32 and the two pressure control valves 18 can be accessed. Moreover, a hydraulic connection C', C is provided at which the pressure downstream of the pressure reducing valve 32 in fluid flow direction is present.

With the aid of small adaptive valve units in form of further modular-type function blocks 42, 44, 46, 48 and 50 different types of safety devices can be quickly provided with different types of safety levels. At the same time, the cost-intensive variance with regard to additional connection and/or endplates is limited. To compensate for a malfunction of the pressure reducing valve 32, an externally connected function block 42 would be suitable, which comprises the rupture disc 38 as a safety device with respect to pressure. Another possibility would be the employment of the function block 44, which comprises a pressure limiting valve 52.

To compensate for the malfunction of the electro-proportional pressure control valves 18, a manually actuated shut-off unit 54 may be connected via the flange 22 as part of the function block 46 that may be connected. A further option is to connect to the function block 48 an electrically operated 2/2-way valve 56 with relief nozzle 58 and optional pressure monitoring 60 on the secondary side. Moreover, the switch position of the 2/2-way valve can also be monitored. A further comparable possibility presents itself through the employment of an electrically operated 3/2-way valve 62, which may optionally also be position-monitored, and may be provided with an optional pressure monitor 60 on the secondary side. The unit so designed can be connected via the function block 50 to the flange 22 as already described. The final possibility described here is to provide monitoring of the pressure directly after the pressure reducing valve 32 via the function block 64. Moreover, basically all function blocks can be employed, with their exchangeable contents as discussed above, together in a control device or, depending on the required safety functionality, a certain combination thereof may be selected.

Figure 4A:
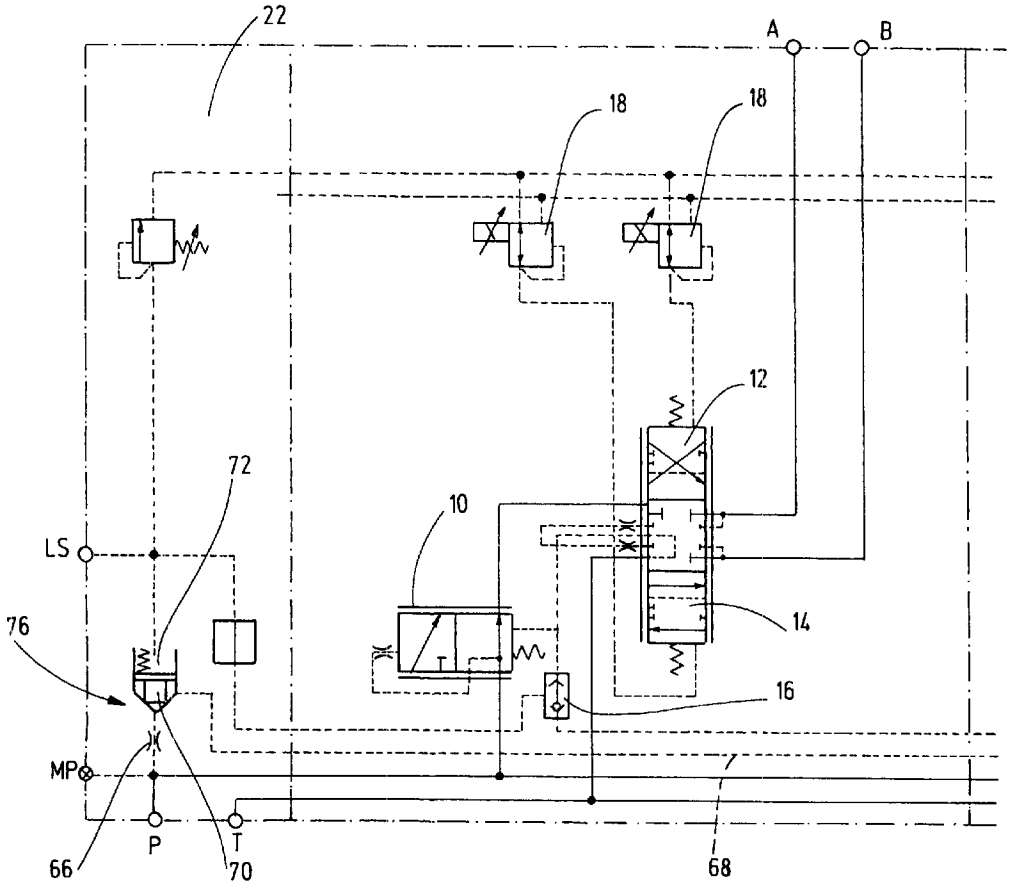
Figure 4B:
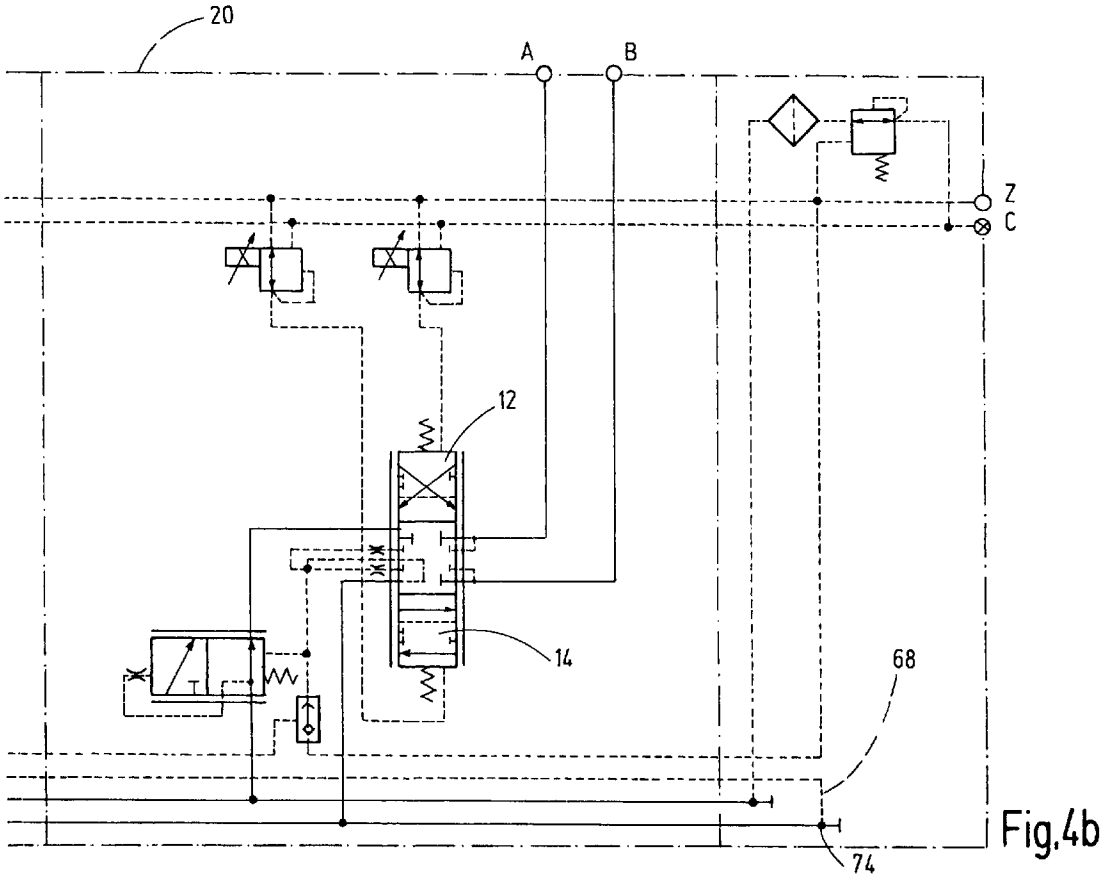

The FIGS. 4*a*, 4*b* also concern a hydraulic LS control block of the kind of control device according to the invention with which, via integrated valve arrangements 10, 14, 16 and 18 that operate as control and regulating valve assembly, individual hydraulic loads may be controlled that are connected to the load connections A and B. The hydraulic energy is again provided by a pressure supply facility P, which may be variable or fixed displacement pumps.

In certain mobile machines such as, for example, loading cranes, truck-mounted cranes, concrete pumps etc. no hydraulic operation may be carried out over a longer period of time. This operation can cause the control device to cool down to ambient temperature, while the pressure medium in the overall hydraulic circuit, and can have a significantly higher temperature due to the operation of separate subsystems. If a control spool 12 of one of the directional control valves 14 is operated now, the warm oil flows into the control spool 12. Since the control spool 12 and its surrounding valve housing may expand differently due to materials used or due to the design and the surrounding flow of the medium being under the influence of temperature, the respective control or valve spool 12 may seize in the associated housing of the directional control valve 14, especially in winter.

In the solution according to the invention as depicted in FIGS. 4*a*, 4*b*, the tempering function is only to be activated when it is necessary, that is, when no hydraulic load is operated. Thus, tempering will occur only if a defined flow rate through the valve block 20 towards the tank connection T is present. If, however, a hydraulic load that is connected to the load connection A, B is operated, no tempering will take place so as not to generate unnecessary power losses. Moreover, there shall be no manipulation of the pressure-reduced pilot pressure supply of the hydraulic pilot control units.

In commonly used LS systems of mobile hydraulic units, the variable displacement pump maintains in the neutral cycle, that is when no hydraulic loads are in operation, a predefined and set pressure differential, for example 25 bar. In the instance of fixed displacement pumps, also a certain low pressure is present at the control block connection, i.e., the pressure supply connection P, which low pressure corresponds to the differential pressure of the neutral cycle circuit (usually >5 bar). In both instances, a low pressure can then be utilised to let a defined volume flow through the control or valve block 20 for the purpose of tempering by using a simple orifice 66.

Importantly, however, that flow is to be able to pass through all spool sections as per the diagram shown in FIGS. 4*a*, 4*b*. If both connections P and T are located in a valve module in form of the valve block 20, flow passage through the valve block is by an additional passage 68. That passage 68 is not provided for a specific purpose, but may be used for different tasks in the overall modular valve system. In this instance, it leads the flow from the connection plate or flange plate 22 through all sections into the endplate, where the flow ends in the T-passages. The T-passages have the fundamental advantage that their cross-section is very large, and thus, are able to emit a lot of heat through their large surface areas.

Figure 5:
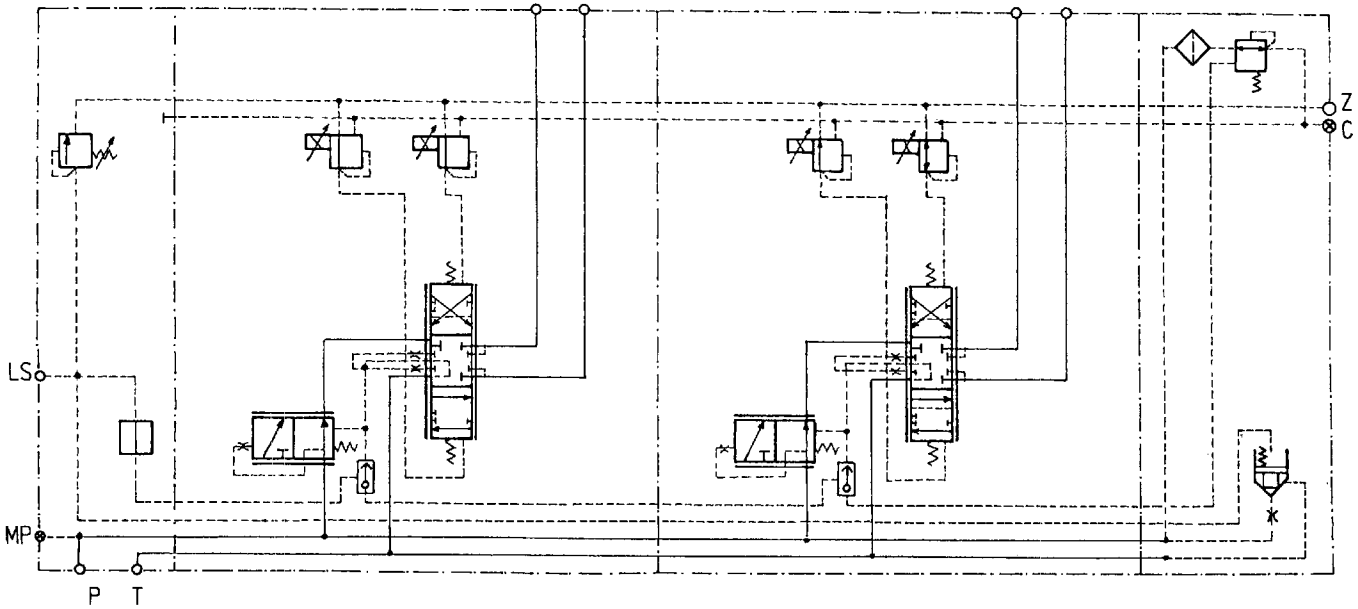

This solution has the further advantage of still being operational if the sections were separated for safety reasons from the actual main hydraulic circuit (not shown) through a P-passage shut-off or a deflector. In this instance, pressure medium can be fed from P through the passage 68 into the endplate, and from there into the T-passages. If such a P-passage shut-off is not present, making the connection, as per the circuit diagram shown in FIG. 5, via the P-passage into the endplate, then via the nozzle or orifice 66 into the T-passages and back again to the connection or flange plate 22, would be more effective. This arrangement would have the advantage of utilising three large passages simultaneously for the purpose of shedding heat.

In the neutral cycle, a defined volume flow is fed via the orifice 66 as well as the open shut-off or closing element 70 of a cartridge valve 72 into the additional passage 68, is passed through all sections into the endplate and then is directly passed into the T-passages, and thus, back to the connection plate 22 and to the tank or return connection T. The transition point 74 for this neutral cycle is shown on the right hand side when viewing FIG. 4. As soon as a load is operated, the load-sensing line (LS chain) signals the load pressure to the connection or flange plate 22 and simultaneously to the closing element 70 of the valve 72. The valve 72 shuts off the tempering function through the additional passage 68 so that no unnecessary thermal losses occur whilst operating the load.

The logic arrangement of the orifice 66 and the shut-off element 70 of the valve 72 may, due to the additional passage 68, be disposed either in the connection or flange plate 22 (FIG. 4*a*) or in the endplate (FIG. 5) in the valve block 20. In the first instance the additional passage 68 is utilised for leading the volume flow to the endplate in form of the valve block 20; in the second instance the highest load-sensing signal of the LS chain is transmitted via this passage 68 back into the endplate onto the shut-off element 70 of the valve 72. As already mentioned, this arrangement at the endplate has the advantage that not only the large T-passages, but also the large pressure supply passage P, can be utilised for the tempering function, where both the T and P connections are disposed in the connection or flange plate 22. In the instance of a P-passage shut-off or a priority or deflector circuit, this arrangement would no longer work. Orifice 66 and the shut-off element 70 of the valve 72 are again an integral unit in form of a module-shaped connectable function block 76. This function block 76 may again be integrated directly in the control or valve block 20 or, as per the diagram in FIG. 4*a*, it may be adapted with the aid of a suitable flange design via the connection or flange plate 22 and fitted to the control or valve block 20. According to a further embodiment that is not depicted in detail, the function block 76 may also be connected together with the pressure reducing valve 32, including filter device 34, at the opposite side, that is on the right hand side when viewing FIG. 4*b*, by a suitable flange or connecting plate 22 to the valve block 20.

While various embodiments have been chosen to illustrate the invention, it will be understood by those skilled in the art that various changes and modifications can be made therein without departing from the scope of the invention as defined in the claims.

The invention claimed is:

1. A control device, comprising:

a pressure supply connection;

a tank or return connection;

first and second load connections;

at least one of control valves or regulating valves connected between said supply connection, said tank or return connection, and said first and second load connections;

first and second control lines connected in fluid communication with and controlling said control valves or regulating valves, said first control line being an oil overflow line; and a modular function block having an input side connected to said overflow line, a first load-sensing line and a second load-sensing line, said overflow line and said first and second load-sensing lines being part of a flange, said modular function block being configured as a pressure limiting valve and controlling said first load-sensing line with a control pressure or being provided with an electromagnetically operable directional control valve having an input port receiving pressure from said second load-sensing line.

2. A control device according to claim 1 wherein said second control line has therein at least one of a safety device against overpressure, a pressure limiting valve, a manually operable shutoff unit, an electromagnetically operable directional control valve or an adjustable flow restrictor.

3. A control device according to claim 1 wherein said modular function block comprises sensors.

4. A control device according to claim 3 wherein said sensors comprise at least one of a pressure sensor or a switch position monitor.

5. A control device according to claim 1 wherein said modular function block is connected within a valve block as an integrated component thereof.

6. A control device according to claim 5 wherein said modular function block is connectable as a standardized modular unit to said valve block.

7. A control device according to claim 1 wherein said at least one of control valves or regulating valves comprises a pressure compensator.

8. A control device according to claim 7 wherein said pressure compensator is an individual pressure compensator.

9. A valve device according claim 1 wherein said at least one of control valves or regulating valves comprises a multi-port spool valve connected to output sides of said first and second load connections in fluid communication.

10. A control device, comprising:

a pressure supply connection;

a tank or return connection;

first and second load connections;

at least one of control valves or regulating valves connected between said supply connection, said tank or return connection, and said first and second load connections;

first and second control lines connected in fluid communication with and controlling said control valves or regulating valves, said first and second control lines being connectable to one another by a pressure reducing valve on a discharge side of said first and second control lines, said second control line having therein at least one of a safety device against overpressure, a pressure limiting valve, a manually operable shutoff unit, an electromagnetically operable directional control valve or an adjustable flow restrictor; and different types of safety devices in form of modular-type function blocks specifying a same predefinable flange, said flange providing access to pressure between the pressure reducing valve and two pressure control valves.

11. A control device, comprising:

a pressure supply connection;

a tank or return connection;

first and second load connections;

at least one of control valves or regulating valves connected between said supply connection, said tank or return connection, and said first and second load connections;

first and second control lines connected in fluid communication with and controlling said control valves or regulating valves; and a tempering function only activatable when in a neutral cycle with no hydraulic load connected to the load connections;

in the neutral cycle, a defined volume flow is passed through all of a plurality of sections of the control device, with the volume flow being fed via an orifice and an open closing element of a valve;

whereby the tempering function is interrupted by signaling a load pressure via a load-sensing line to the closing element of the valve.

* * * * *